US005897741A

United States Patent [19]

Mills et al.

[11] Patent Number: 5,897,741

[45] Date of Patent: Apr. 27, 1999

[54] APPARATUS FOR APPLYING SECURITY TAGS TO LABELS

[75] Inventors: Nigel Graham Mills, Kettering; Terry Lynn Rich, Dayton, both of Ohio

[73] Assignee: Premark FEG L.L.C., Wilmington, Del.

[21] Appl. No.: 09/020,968

[22] Filed: Feb. 9, 1998

[51] Int. Cl.[6] ..... B65C 9/08

[52] U.S. Cl. ..... 156/541; 156/64; 156/297; 156/360; 156/521; 156/542; 156/556; 428/41.4

[58] Field of Search ..... 156/541, 542, 156/64, 521, 556, 297, 360; 428/41.4

[56] References Cited

U.S. PATENT DOCUMENTS

| | | | |
|---|---|---|---|
| 3,907,627 | 9/1975 | Treiber | 156/538 |
| 3,985,603 | 10/1976 | Berner | 156/235 |
| 3,985,605 | 10/1976 | Treiber et al. | 156/384 |
| 3,989,929 | 11/1976 | Treiber | 235/61.9 |
| 4,111,121 | 9/1978 | Borum | 101/227 |
| 4,191,605 | 3/1980 | Katterheinrich | 156/285 |
| 4,330,097 | 5/1982 | George et al. | 242/187 |
| 4,351,690 | 9/1982 | George | 156/384 |
| 4,375,189 | 3/1983 | Berner | 101/68 |
| 4,390,390 | 6/1983 | Margraf et al. | 156/566 |
| 4,561,921 | 12/1985 | Treiber | 156/297 |
| 4,615,757 | 10/1986 | Treiber | 156/350 |
| 4,652,863 | 3/1987 | Hultman | 340/551 |
| 4,673,923 | 6/1987 | Boscoe et al. | 340/572 |
| 4,676,343 | 6/1987 | Humble et al. | 186/61 |
| 4,705,588 | 11/1987 | Trieber | 156/360 |
| 4,787,953 | 11/1988 | Trouteaud et al. | 156/387 |
| 4,857,121 | 8/1989 | Markley et al. | 156/64 |
| 4,895,614 | 1/1990 | Trouteaud et al. | 156/542 |
| 4,964,053 | 10/1990 | Humble | 364/466 |
| 5,078,816 | 1/1992 | Ratermann | 156/64 |
| 5,081,445 | 1/1992 | Gill et al. | 340/572 |
| 5,133,827 | 7/1992 | Ratermann | 156/361 |
| 5,221,405 | 6/1993 | Trouteaud | 156/364 |
| 5,376,217 | 12/1994 | Janssen, Jr. et al. | 156/361 |
| 5,442,334 | 8/1995 | Gallo et al. | 340/572 |
| 5,496,611 | 3/1996 | Ikeda et al. | 428/81 |
| 5,507,583 | 4/1996 | Beaty et al. | 400/611 |
| 5,614,278 | 3/1997 | Chamberlain et al. | 428/41.4 |

*Primary Examiner*—David A. Simmons
*Assistant Examiner*—Robert R. Koehler
*Attorney, Agent, or Firm*—Thompson Hine & Flory LLP

[57] ABSTRACT

An apparatus for attaching an electronic security tag to a freshly printed label, each label having an adhesive side and a printable side. The apparatus comprises a supply roll including a backing and a plurality of security tags attached thereto for supplying the electronic security tags. The apparatus further comprises means for printing indicia on the printable side and delivering the label to a label support. The apparatus includes a stripper element for separating the security tags from the backing at a label application station. The separated security tag is then attached to the label.

21 Claims, 1 Drawing Sheet

APPARATUS FOR APPLYING SECURITY TAGS TO LABELS

BACKGROUND OF THE INVENTION

The present invention relates to an apparatus and method for applying security tags to labels, and more particularly, to an apparatus and method for applying electronic security tags to freshly-printed labels for application to a package, and even more particularly, for applying electronic security tags selectively to printed labels.

Supermarkets are experiencing increasing theft of various food products, such as packaged meat. Due to an increase in theft and shoplifting of these products, various security measures may be incorporated into the products to discourage theft. One such counter-theft measure is the use of electronic security tags, such as electronic article surveillance (EAS) tags, which are attached to the article to be protected. Accordingly, there is a need for an apparatus for applying security tags, such as EAS tags, on food products. Food products displayed in supermarkets often include a label on their outer lid or wrapping which includes information such as the weight, price, unit weight, total price, or a description of the packaged item. The labels may also include advertising or a UPC bar code symbol. In order to mask the security tag, electronic security tags may be applied to the adhesive side of the labels, and the label and tag may then be applied to the article. In order to avoid having to prepare, store and inventory labels having attached security tags, it is advantageous to apply the security tag to the label immediately prior to attaching the label to the package. Accordingly, there exists a need for an apparatus and method which can quickly and accurately place an electronic security tag on a label to be attached to a package.

SUMMARY OF THE INVENTION

The present invention is an apparatus for attaching an electronic security tag to a freshly printed label. Each label has an adhesive side and a printable side. The apparatus comprises a supply roll including a backing and a plurality of security tags attached thereto for supplying the electronic security tags. The apparatus further comprises a printer for printing indicia on the printable side of the label and delivering the label to a label support with the adhesive side facing the tag supply. The apparatus includes a stripper element for separating the security tags from the backing, the stripper element being located such that the separated security tag can be applied to the adhesive side of the label and is thereby attached to said label.

The present invention further includes a method for applying an electronic security tag to a freshly-printed label, the method comprising the steps of providing a freshly printed label having an adhesive side and a printed side, providing a supply roll of security tags, separating a tag from the supply roll, and applying the separated security tag to the adhesive side.

In one embodiment, the security tag may include inductance-capacitance circuits which are resonant within a frequency range. An apparatus which generates a radio frequency field in a predetermined frequency range is supplied in the exit path of the protected premises. When an article and tag are carried out the protected exit, the tag disturbs the RF field in a manner which can be sensed by a tag detector. The tag detector provides an output which can be used to operate an alarm, buzzer or light. When the item is purchased and processed at checkout, some tags are designed to be deactivated by subjecting the tag to a frequency of a higher energy than that employed for detection. This destroys a fusible link contained within the resonant circuit so that tag detection is no longer possible. The tags may be deactivated by a bar code scanner at checkout. Alternately, the security tags are not deactivated, and the protected item is instead passed around the alarm mechanism by a store employee once the item is purchased. Antitheft tags may also comprise an electroconductive non-magnetic metal member applied to a soft magnetic metal strip, or other tags commonly used in the art. In general, antitheft tags are generally flat, planar tags which can lay flat against the item to be protected.

Utilizing the present invention, security tags (EAS tags) are quickly and effectively secured to a package. Furthermore, the security tags are located near the top of the package so that they may be easily deactivated in those cases where they are designed to be deactivated. The deactivation may occur when the bar code on the label is scanned. The security tag may be applied to a primary label or any other merchandising label attached to the package. The label hides the tag to prevent removal of the tag, and also masks the fact that the package is electronically protected. Application of the tag after the label is printed allows the printer to print on the uniform surface of a label, and avoids the difficulties of thermally printing on the uneven surface of a label and tag combination. Furthermore, the tag may be applied to a selected package based on certain parameters. The type of product, the price per unit weight, or the total weight or total price of the product may be utilized as application parameters. The selective application allows for more economical and effective use of the security tags. Because the tags are relatively expensive, in this manner the tags may be applied only to those items which are more heavily targeted for theft. For example, products retailing for over a predetermined price point such as $5.00, or those above a certain price per pound, may selectively receive a security tag while less expensive products would not.

These and other objects and advantages of the present invention will be more fully understood and appreciated by reference to the following description, the accompanying drawings and the appended claims.

DETAILED DESCRIPTION

Figure 1:
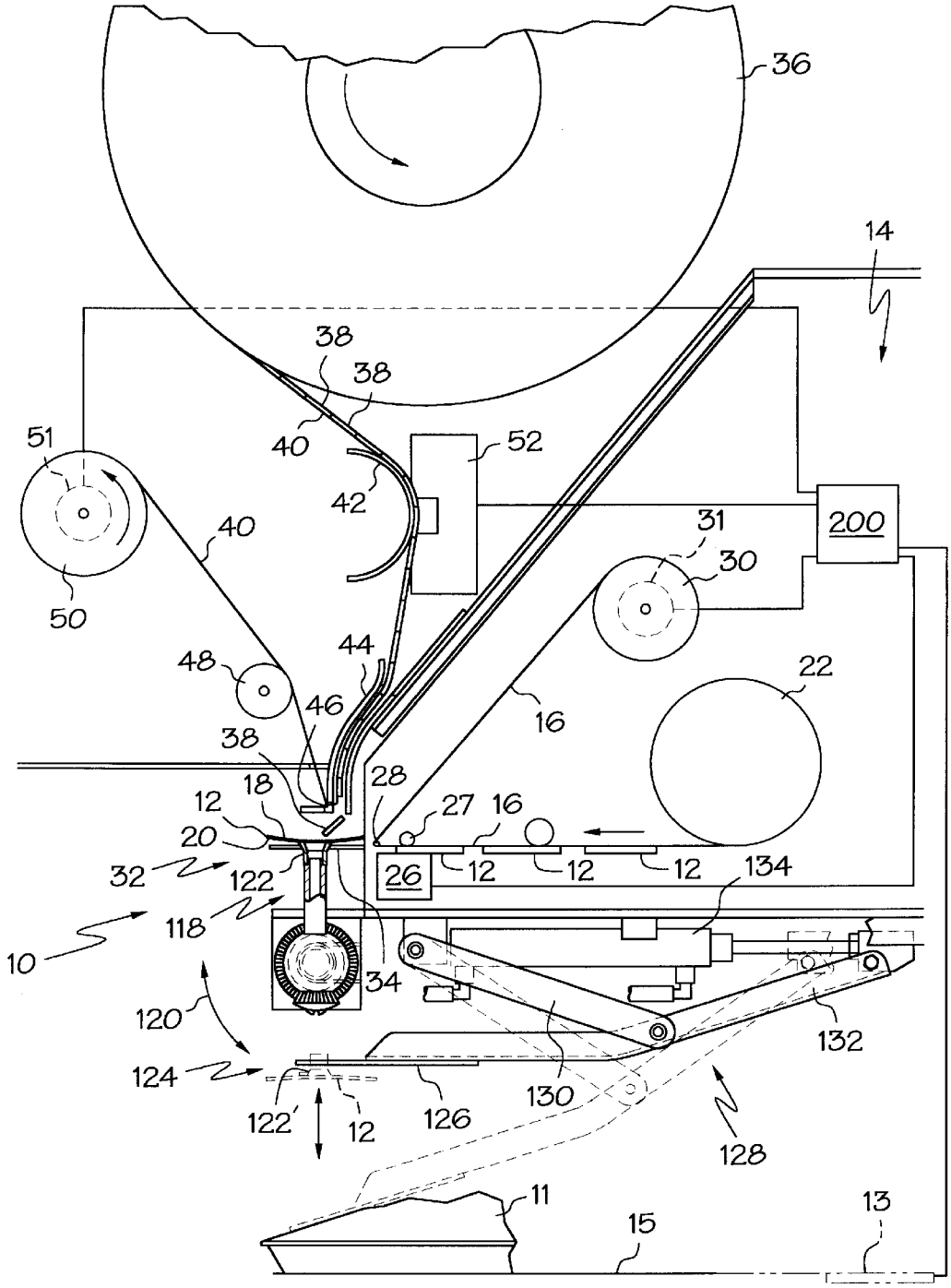
FIG. 1 is a side elevational view illustrating the electronic security tag application apparatus of the present invention, shown in conjunction with a label applicator.

FIG. 1 illustrates, somewhat schematically, an apparatus, generally designated 10, which weighs packages, prints labels, applies a security tag to the labels, and applies the labels to the packages. The apparatus 10 may be used with a conveyor 15 to move the packages into the appropriate position. However, a conveyor is not essential to the invention, and instead of a conveyor the items to be packaged may be simply placed in the proper position by an operator. Furthermore, the automatic label application is not essential to the invention, and the labels may be placed on the package by hand. Although these various embodiments may be used without departing from the scope of the invention, the apparatus is herein described with the use of a conveyor and a label application apparatus.

To initiate operation, packages 11 are loaded either manually or automatically onto a conveyor 15. Each of the packages is conveyed to a weighing station, where a scale 13 measures the package weight. Weighing can be performed on-the-fly or with the conveyor coming to a stop for a weighing operation, depending upon the design and performance characteristics of the unit. Alternately, an operator may place the package directly on the scale. The weight information is communicated to a controller 200 which may include a microprocessor. The controller computes the total price of the package by multiplying the price per unit weight by the measured weight of the package. This information, as well as other desired indicia, is then printed on a label 12 by printer 14.

The printer 14 prints upon blank labels 12 having one side coated with a pressure-sensitive adhesive. The labels 12 are carried on a strip of release material 16. Each label 12 has an adhesive side 18 and a non-adhesive printable side 20. The blank labels are supplied by a label supply roll 22. Print head 26 prints indicia on the printable side 20 of the label 12 as the labels are passed through the printer, and print roller 27 supports the labels 12 as they are printed. The printed labels may include such information as the weight, price per unit weight, total price, or a description of the packaged item, as well as advertising or a UPC bar code symbol. The print head 26 may be a thermal printer of the type having an array of individually energizable heater elements which are selectively activated. After printing by print head 26, each label 12 is separated from the release material 16 by drawing the release material 16 under tension around a sharp bend provided by stripper bar 28. The labels 12 are transported through the printer 14 by a drive mechanism 31 connected to take-up hub 30 upon which the release material 16 is wound. The label 12 is then discharged from the printer unit at the label pickup station 32. When it is discharged, the label 12 has its adhesive side 18 facing toward the tag supply location 46 of the tags and is received on the label support means 34. While the invention is illustrated in the figure using linered label stock, those skilled in the art will appreciate that linerless label stock is equally useful in practicing the invention. Additionally, the tags of the present invention may be applied to any type of label which is applied to the package, including pre-printed labels such as predetermined price or bar code labels, or merchandising labels. Where pre-printed label stock is used in the invention, the print head 26 may not be used.

The security tag supply roll 36 comprises a plurality of electronic security tags 38 adhesively attached to a backing 40. The tags 38 and backing 40 are passed around a semicircular guide 42 and a guide plate and stripper element 44. The guide plate has a comer 46 at its bottom end. When the backing 40 and security tags 38 pass around the corner 46, the security tags 38 are stripped off of the backing 40, and applied to the adhesive side 18 of the label 12 below. The backing 40 then passes around a guide roller 48 and is collected by the take-up reel 50. In the present embodiment the tag falls to the adhesive side 18 of the label 12 below, but the plate 44 can also be located close enough to the label 18 that the tag is directly applied. Once applied, the security tag 40 adheres to the adhesive side 18 of the label 12. Preferably, the tag has an adhesive on one of its sides, and the tag is applied such that the adhesive side of the tag is facing outwardly. This helps to adhere the label-tag combination to the package 11.

The take-up reel 50 is rotationally coupled to a motor 57 to drive the rotation of the supply roll 36. A detection mechanism 52 such as an optical sensor which typically employs a light beam to detect the leading edge of a security tag is provided upstream of the stripping point to detect the presence of a security tag 38. The detection mechanism 52 is used in controlling the motor to ensure that the supply roll 36 is advanced one security tag at a time. In this manner, once a label 12 is printed and ready to receive tag 38, rotation of the supply roll 36 via take-up reel 50 is coordinated with the detection mechanism 52 such that one security tag 38 is stripped from the backing material 40 and deposited on a label below.

It should be noted that the security tags 38 used with the invention may be any of those commonly used in the art which can be accommodated by the present invention. These include radio frequency and electromagnetic tags, commercially available from Checkpoint and Sensormatic. The apparatus of the present invention may be easily modified to accommodate various types of security tags. Additionally, the supply roll 36 may be replaced with a cartridge-dispenser wherein the security tags 38 are ejected directly from the cartridge onto the label 12. In this embodiment neither side of the tag has an adhesive.

The apparatus 10 and the method of the invention further provides for selective application of the security tags. It will not generally be necessary or economic to apply tags to all items labeled. Certain parameters may be used to determine which items should receive tags and when the parameters are not met the roll 36 is not advanced and the security tag is not applied. These parameters may include the type of product, total weight or total price, or even random application of the tags. Accordingly, the take-up reel 50 will only advance the supply roll to place a tag on a label when the controller has determined that the item being labeled requires a security tag. If the item does not require a tag, the take-up reel will not advance. If the take-up reel is advanced, it will continue doing so until the leading edge of the next tag has been detected at detector 52.

Once a label 12 has received a tag 38, the operator may remove the label 12 from the label support means 34 and apply the label and tag to an article of merchandise 11 by hand. In this manner, the security tag is fixedly applied to the article, making it secure from theft. Additionally, the security tag is hidden from sight by the label. In an alternate embodiment the label and tag combination may be automatically applied to the package. Several methods for applying a label to a package are known in the art and may be used in conjunction with the present invention. For example, the label may be "blown" onto the package by means of pressurized air. A preferred embodiment for mechanically applying the label to the package employs a wand and is described in greater detail below.

In a preferred embodiment for applying the labels, the support means 34 has a notch or cut-out formed therein to receive a wand 118 having a vacuum cup 122 at its distal end. The wand 118, along with the label support means 34, receives the label 12 when it is supplied by the printer. A vacuum retains the label 12 on the vacuum cup 122 at the end of the wand 118. The wand 118 and cup 122 together comprise a label transporter. Once a tag has been applied to the label 34, the wand 118 pivots downwardly along arrow 120 to the dotted line position of the vacuum cup 122', where it arrives at a delivery station 124. As the label reaches the delivery station 124, it is positioned below a stripper plate 126 of a label applying assembly 128. In this position, the adhesive side 18 of the label is facing downwardly.

The label applying assembly 128 includes two pairs of pivotally-connected scissor-action arms 130 and 132 which are actuated by an air cylinder 134. When so actuated, the air cylinder 134 causes the stripper plate 126 to move downwardly, and thereby remove the label 12 from the vacuum cup 122 and slap it onto a package 11. Timed vacuum means (not shown) applies a vacuum to the vacuum cup 122 at the time of pick-up of a label, maintains the vacuum "on" throughout its rotary travel to the transfer station, and releases the vacuum just as the cylinder 134 performs the transfer function.

Once the label 12 and tag 38 are applied to the package, the package 11 may be manually removed or conveyed to the next station for further processing. While the conveyor 15 may be a stand-alone unit for carrying previously-wrapped packages the labeler of the present invention, the present invention may also be used in conjunction with an automatic wrapping machine such as is described in U.S. Pat. No. 4,813,211, hereby incorporated by reference. The conveyor is connected to such a wrapping machine at its exit end and conveys the product from the wrapping machine to the apparatus of the present invention.

While the forms of apparatus herein described constitute a preferred embodiment of the invention, it is to be understood that the present invention is not limited to these precise forms and that changes may be made therein without departing from the scope of the invention.

What is claimed is:

1. An apparatus for printing a label and automatically and selectively attaching an electronic security tag thereto to thereby be affixed to a package, said label having an adhesive side and a printable side, the apparatus comprising:

a plurality of security tags;

means for delivering a security tag of said plurality to a tag supply location;

a printer for printing indicia on said printable side of said label;

means for delivering said label to a label support with said adhesive side facing said tag supply location; and means for selectively applying said security tag from said tag supply location to said adhesive side of said label, said means including a controller for receiving information regarding at least one parameter of the package to which said label is to be applied, wherein said controller determines whether said security tag is applied to said adhesive side of said label based at least in part upon said at least one parameter of the package to which said label is to be applied.

2. The apparatus of claim 1 wherein said plurality of security tags are provided on a roll of backing material having security tags affixed thereto and said means for selectively applying said security tag to said label includes a stripper element about which said backing is conveyed, said security tag being separated from said backing as said backing passes about said stripper element.

3. The apparatus of claim 2 further comprising a takeup roll for collecting said backing after passing around said stripper element.

4. The apparatus of claim 3 further comprising a motor rotationally coupled to said take-up roll for advancing said backing around said stripper element.

5. The apparatus of claim 2 further comprising a sensor for detecting the presence of an electronic security tag such that said roll supplies one security tag at a time.

6. The apparatus of claim 5 wherein said sensor is an optical sensor.

7. The apparatus of claim 1 wherein said controller is connected for controlling said printer, the apparatus further comprising a scale coupled to said controller for supplying package weight data to said controller such that said weight data may be incorporated in said indicia printed on said printable side of said label by said printer and wherein said controller utilizes said weight data in determining whether said security tag is applied to said adhesive side of said label.

8. The apparatus of claim 1 further comprising a label transporter for moving said label from said label support to a label delivery station, said transporter including a rotatable wand having a vacuum cup at its distal end.

9. The apparatus of claim 8 further comprising a label applying assembly for transferring said label from said label delivery station to said package.

10. A method for automatically and selectively applying electronic security tags to printed labels to be applied to packages, the method comprising the steps of:

(a) providing a supply of labels each having an adhesive side and a printable side;

(b) printing indicia on the printable side of each label, each label's printed indicia being determined by a package to which said label is to be applied;

(c) providing a supply of security tags;

(d) establishing at least one package parameter for applying a security tag from said supply to said printed labels; and (e) for each printed label performing the following steps:

(i) applying a security tag from said supply to said adhesive side of said label only if the package to which said printed label is to be applied at least meets said established package parameter; and (ii) applying said label to said package.

11. The method of claim 10 wherein said supply of security tags includes a roll of backing material having security tags affixed thereto and when a security tag is applied in step (e)(i) said tag is first separated from said backing.

12. The method of claim 11 wherein said separating step includes providing a stripper element for separating said security tag from said backing and conveying said backing around said stripper element.

13. The method of claim 12 wherein when a security tag is applied in step (e)(i) said printed label is positioned with said adhesive side upwards and said separating step includes locating said stripper element above said printed label such that said separated security tag falls onto said adhesive side of said label.

14. A method for automatically applying electronic security tags to packages in a selective manner, said method comprising the steps of:

(a) establishing at least one application parameter for applying a security tag to each package;

(b) providing an automated machine for receiving packages, said automated machine including a supply of security tags and a supply of labels, said automated machine repeatedly performing the following steps:

(i) positioning a label to be applied to a particular package adjacent to a security tag supply location;

(ii) determining whether the particular package meets the established application parameter;

(iii) selectively applying a security tag to the positioned label based at least in part upon the determination made in step (b)(ii);

(c) applying the positioned label to the particular package regardless of whether a security tag is applied to the positioned label in step (b)(iii).

15. The method of claim 14 wherein the application parameter established in step (a) is a predetermined price per unit weight.

16. The method of claim 14 wherein the application parameter established in step (a) is a predetermined total price, wherein said automated machine provided in step (b) includes a scale and wherein step (b)(ii) includes weighing the particular package to determine its weight and multiplying the determined weight by a price per unit weight.

17. The method of claim 14 wherein said automated machine provided in step (b) includes a printer and said automated machine performs the further step of printing indicia of the particular package on the label prior to positioning the label adjacent to the security tag supply location.

18. An apparatus for selectively applying electronic security tags contained on a roll of backing material to packages by selectively attaching such security tags to labels to be applied to the packages, the apparatus comprising:

a stripper element;

means for passing the backing material around said stripper element for stripping security tags therefrom;

a label support positioned below said stripper element;

means for positioning a label to be applied to a particular package on said label support;

a scale for determining a weight of the particular package; and a controller for receiving weight information from said scale, said controller connected for controlling said means for passing said backing material around said stripper element, said controller operable to determine if the particular package meets an established package parameter for applying security tags to labels, and to effect passage of the backing material around said stripper element so as to apply a security tag to said label on said label support only if the particular package is determined to meet said established package parameter.

19. The apparatus of claim 18 wherein said established package parameter is a predetermined total price and said controller is operable to determine a total package price for the particular package by multiplying said weight information received from said scale by a price per unit weight.

20. The apparatus of claim 18 further comprising a printer for printing package indicia on said labels, said printer positioned adjacent said label support for providing printed labels thereto.

21. The apparatus of claim 19 further comprising means for applying said label positioned on said label support to the particular package.

* * * * *